US005761868A

United States Patent [19]

LaLonde et al.

[11] Patent Number: 5,761,868

[45] Date of Patent: Jun. 9, 1998

[54] GRID CONNECTOR

[75] Inventors: Paul D. LaLonde, Avon; Gerald L. Koski, Parma; James J. Lehane, Columbia Station, all of Ohio

[73] Assignee: USG Interiors, Inc., Chicago, Ill.

[21] Appl. No.: 690,845

[22] Filed: Aug. 1, 1996

[51] Int. Cl.[6] ..... E04B 2/00

[52] U.S. Cl. ..... 52/506.07; 52/664

[58] Field of Search ..... 52/506.06, 506.07, 52/664, 665, 666, 667, 668

[56] References Cited

U.S. PATENT DOCUMENTS 5,271,202 12/1993 Vukmanic et al. ..... 52/506.07 X 5,517,796 5/1996 Koski et al. ..... 52/506.07

*Primary Examiner*—Creighton Smith

*Attorney, Agent, or Firm*—Pearne, Gordon, McCoy and Granger LLP

[57] ABSTRACT

An end connector for a ceiling grid runner that interlocks with an identical connector when assembled in a common slot of a through runner. Problems associated with interference between a lock lance stamped laterally out of the plane of the connector and the opposing connector when the second connector is being inserted in the slot are reduced by a relief zone in the forward portion of the connector that is in the form of a concave area that clears the opposing lock lance until the second connector is nearly fully received in the slot.

11 Claims, 5 Drawing Sheets

66
61
75
58
57
52
59
64
56
63
53
51
47
33
35
31
46
34
43
32
41
29
37
28
42
44
27
45
62
26
61
60
64
63
44
61
62
51
60
47
52
57
56
51
41
61
60
62

GRID CONNECTOR

BACKGROUND OF THE INVENTION

The invention relates to suspended ceiling construction and, in particular, to an improved connector structure for suspended ceiling grid members.

PRIOR ART

Suspended ceiling metal grid work typically involves an assembly of through runners and cross runners in the general shape of inverted tees. Conventionally, the cross runners are provided with connector structure on their ends. For assembly of the grid, these connectors are inserted into holes or slots formed in the webs of the main or through runners. An important feature found in certain cross runner end connectors is a so-called connector-to-connector lock that establishes a direct interconnection between end connectors inserted into the same slot from opposite sides of the through runner. A connector-to-connector lock can produce a more dimensionally accurate grid and is capable of resisting substantially higher tensile forces than ordinarily achieved with a connection to the through runner. Thus, where high tensile load capacity is important, a connector-to-connector lock is preferred. A common approach to producing a high tensile connector-to-connector lock is to create a so-called lance lock by stamping a rigid projection out of the sheet metal stock forming the connector. The lance lock typically has a generally rearwardly facing edge that is displaced laterally from the main plane of the connector and stock material forward of the edge, for the most part, remains continuous with the surrounding area of the connector for strength. As a result, the lance lock itself is essentially unyielding in a lateral direction.

The connector is also made with a rearwardly facing receiving edge forward of the lock lance edge. The lock lance edge of one connector mates with the receiving edge of the opposite connector. The connectors are laterally confined by the slot of the through runner into which they are assembled so as to hold the laterally projecting lock lance engaged with the receiving edge. A problem can occur during the installation of the second connector into the slot. Since the slot is designed to laterally restrain the connectors, the slot resists the tendency of the second connector to shift laterally away from the opposite connector as the lead ends of the connectors encounter the projecting lock lances and a potentially high interference condition between the connectors and slot exists.

The resulting interference can, for example, involve undesirable cutting into or gouging any soft coating on the connectors and/or bending of the edges of the slot particularly when the gauge of the metal of the slot is relatively thin. These and other occurrences can lead to irregular and/or excessive installation forces that can make the installation job more difficult, frustrating and less precise.

SUMMARY OF THE INVENTION

The invention provides an improved ceiling grid connector that has a connector-to-connector lock feature and which avoids irregular assembly action by reducing or eliminating required bending deflection, cutting or shearing of elements of the grid or connectors. According to the invention, the connector geometry has a zone that is devoid of any stock and is situated to reduce interference with the forward part of the lock structure of a similar, preferably identical, opposing connector to which it is being assembled. In the disclosed embodiment, the interference reducing zone is in the form of a relief or hollow stamped or otherwise made in the lead portion of the connector. More specifically, the stock of the connector forming the relief is deformed laterally from a main plane of the connector allowing it to reinforce an adjacent lock engaging or receiving surface. The reinforcement function of the relief area insures that the connector will produce a high tensile force connection. The disclosed connector arrangement includes a so-called first end lock permitting it to be assembled into a slot and to be automatically self-retained therein. Still further, the connector produces a connection with a high compressive force capacity between mating connectors.

The disclosed relief zone has the affect of delaying connector-to-connector lock induced interference between the pair of connectors being joined and the slot in which they are received. Ideally, the interference is delayed until the second connector is nearly completely inserted into the slot of the cross runner. This reduces the risk that extraordinary resistance or interference will be developed between the slot and connector due to a tendency of the connector to bite into the edge of the slot or to bend the material forming the slot which can be of special concern when the material of the through runner is relatively light gauge stock. The disclosed relief zone, once engagement of the relevant surfaces is established, works in the manner of a wedge or cam that spreads out the forces of engagement over a large area so as to avoid concentrated compressive stresses. The interference reducing zone, represented by the disclosed relief area, can produce a surprising reduction in the force required to assemble a pair of connectors and can produce a surprising improvement in the consistency of the requisite force levels.

DESCRIPTION OF THE PREFERRED EMBODIMENT

The disclosure of U.S. Pat. No. 5,517,796 is incorporated herein in its entirety by reference.

Figure 1:
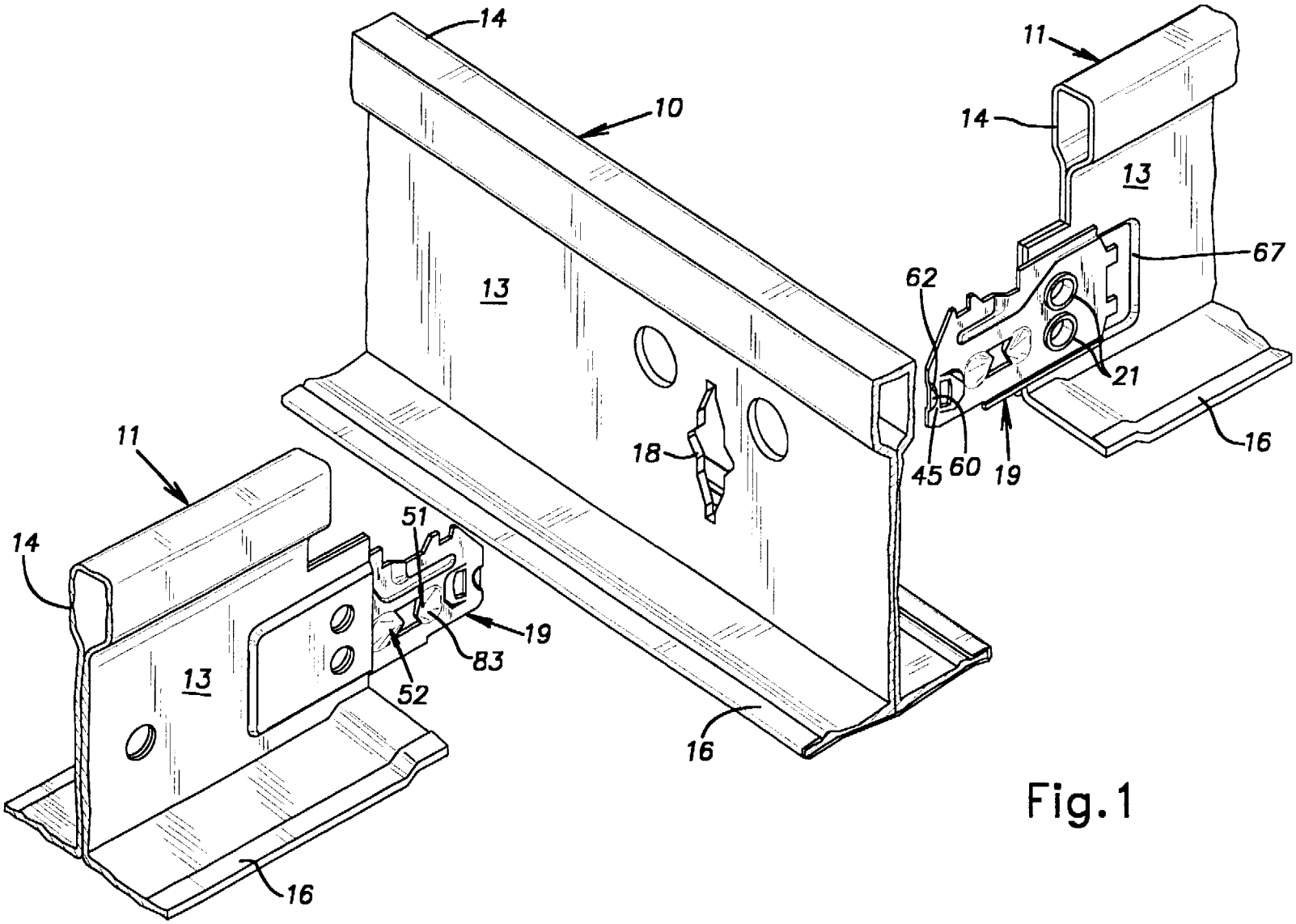
FIG. 1 is a fragmentary perspective view of the ends of an opposed pair of cross runners with end connectors and aligned with a receiving slot in a main or through runner.

FIG. 1 illustrates a portion of a main or through runner 10 and cross runners 11 forming intersections in a suspension ceiling grid system in accordance with the present invention. In the illustrated embodiment, all of the runners 10 and 11 are tees formed with a central web 13, a stiffening bulb 14 along one edge of the web 13, and oppositely extending panel supporting flanges 16 along the lower or opposite edge of the web. Ordinarily, the runners 10, 11 are assembled with their longitudinal axii lying in a horizontal plane and their webs 13 lying in vertical planes. It should be understood, however, that in accordance with the broader aspects of the invention, the disclosed connecting structure can be applied to other forms of grid tees or runners and that the particular tee structure is illustrative of one preferred embodiment of this invention. It should be further understood that the grid tees are typically formed of thin sheet metal which is bent to the cross section illustrated. However, in accordance with the invention, the grid tees can be formed in other ways, e.g. by extrusion or the like.

In many grid systems for suspension ceilings, a horizontal array of parallel, laterally spaced main tees or runners are supported from the building structure above the grid by wires or the like, and cross tees or runners interconnect with the main runners, with two opposed cross runner ends positioned on opposite sides of the main runner at each intersection. However, this invention is also applicable to basket weave type grid systems in which main runs and cross runs are not provided, strictly speaking. Both types of grid systems, however, provide intersections in which a through runner extends past opposed runner ends which interconnect with the through runner at intersections. Therefore, as used herein, the term "through runner" is used instead of "main runner" so as to encompass basket weave grid systems, main run and cross run grid systems, and other types of grid systems which may incorporate the present invention. Typically, the runners of a suspension ceiling grid system are interconnected to form rectangular or square openings bounded by flanges 16.

Figure 6:
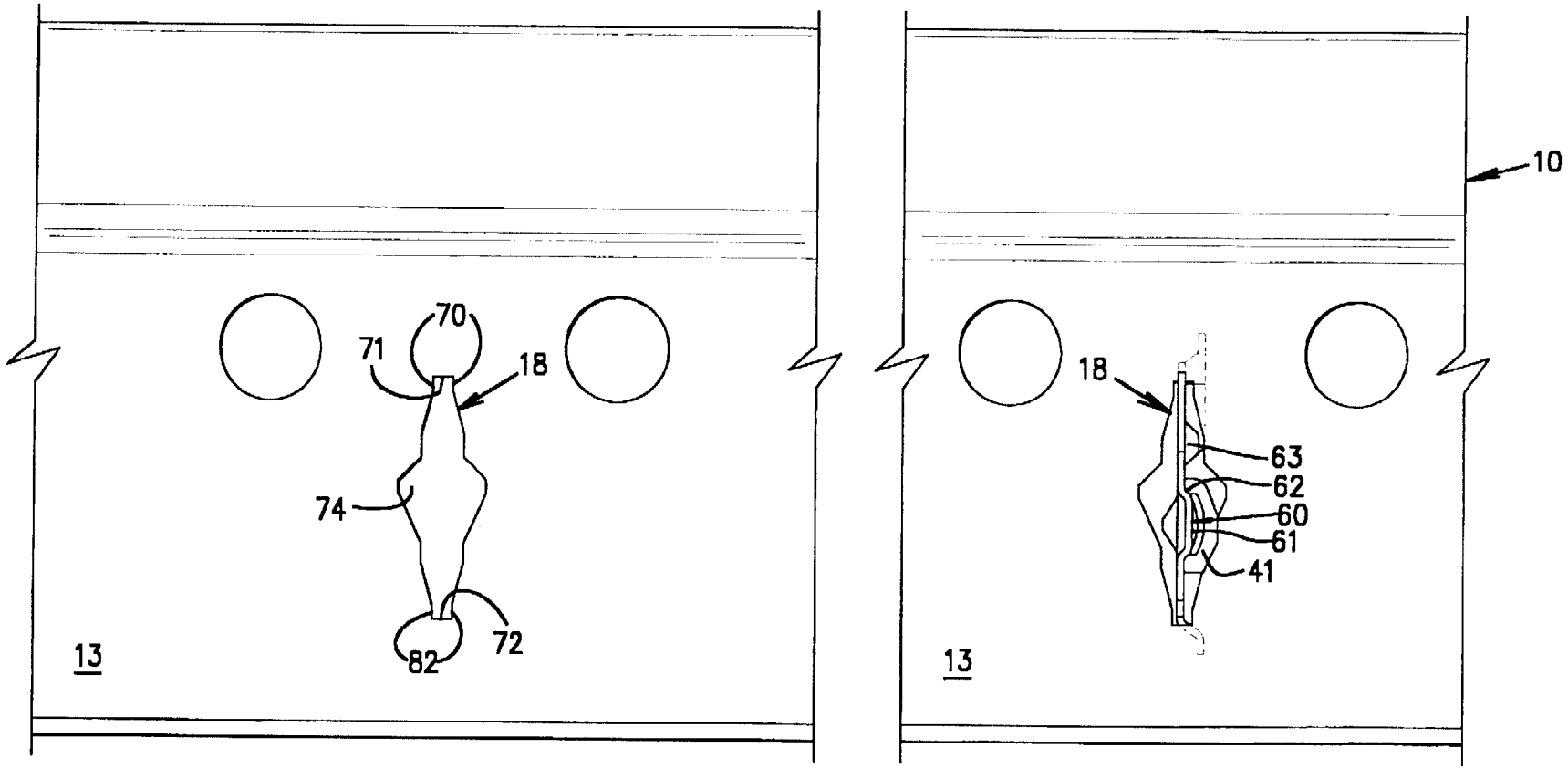
FIG. 6 is a fragmentary elevational view of the connector assembled in the respective slot of the main runner as well as an adjacent slot without a connector.

Referring particularly to FIGS. 1 and 6, the web 13 of the through runner 10 is formed with a connector opening 18, and the ends of the two cross runners 11 are provided with similar, and preferably identical, connectors 19. In the illustrated embodiment, the connectors 19 are formed of separate elements and are connected to the webs 13 of the runner ends by a clinch-like connection 21 known in the art.

Figure 7:
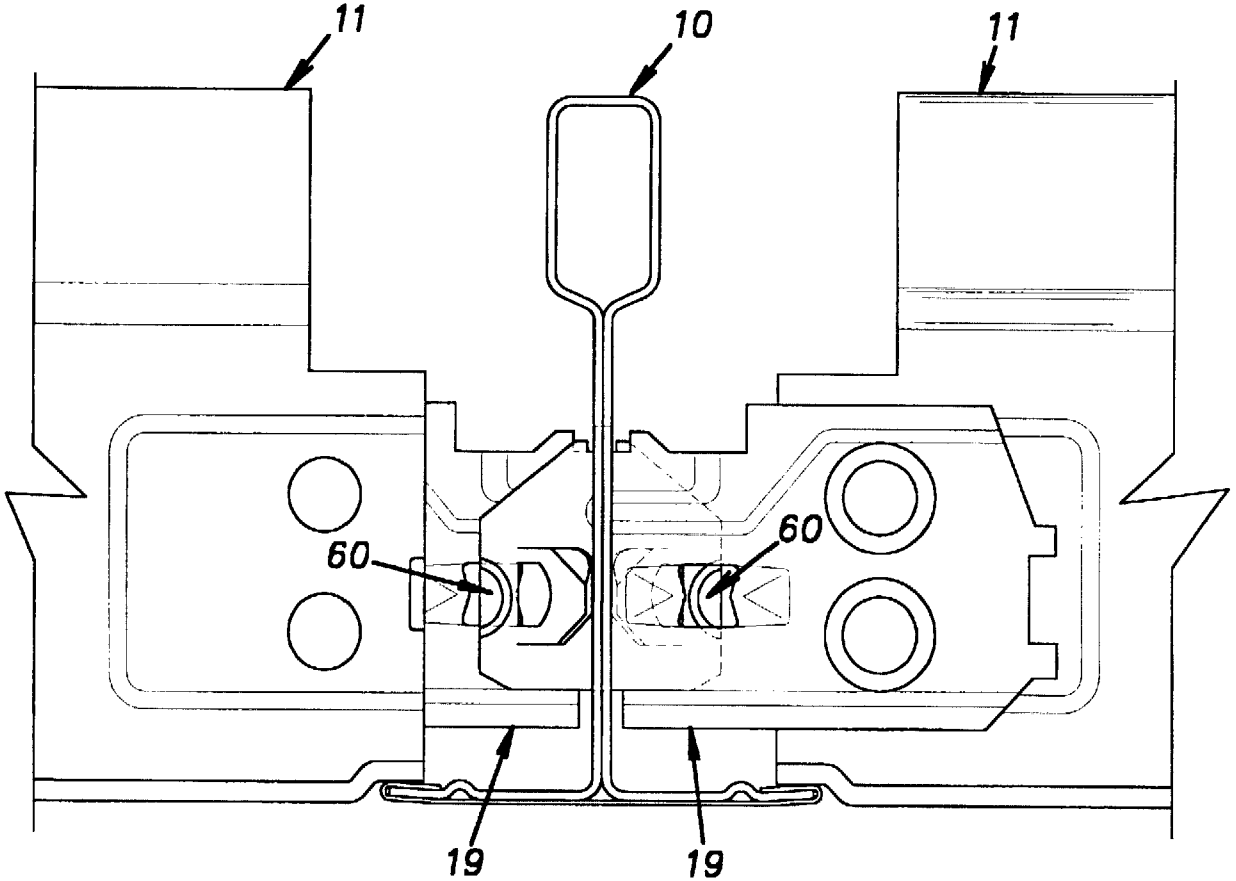
FIG. 7 is a view showing a pair of opposed connectors assembled and locked together in a main runner slot.

FIG. 1 illustrates the runners before either connector is installed in the opening 18. FIG. 6 illustrates the condition after the connector 19 of the first runner end is installed in the opening 18 and is held therein by the first end lock discussed below. FIG. 7 illustrates a completely assembled intersection of two runners 11 and the through runner 10.

A connector 19 is preferably stamped from high strength steel sheet stock. Major surface areas of the connector 19 retain their original planar configuration and represent the plane of the connector body while other areas described below are stamped out of the original plane. The connector 19 which in use normally lies in the vertical plane of its runner web 13, has a lead end 26 with an irregular, somewhat angular profile. The lead end 26 includes a generally vertical lead edge or nose 27, a lower minor bevel 28 and a major upper bevel 29; the bevels 28, 29 facilitate insertion of the connector 19 into the slot 18 of the through runner 10. A lower edge 31, lying in a vertical plane transverse to the plane of the connector, is adapted to abut the web 13 of the through runner 10. Along its upper edge, the connector 19 includes a pair of projections 32, 33 providing opposed abutment or stop edges 34, 35 facing rearwardly and forwardly, respectively. The rear edge 34 of the forward projection 32 is spaced horizontally from the lower vertical edge 31 a distance at least as great as the thickness of the web 13 of the through runner 10. The forward edge 35 of the rear projection is spaced slightly rearwardly of the lower edge 31 so that with respect to the forward projection 32, it also provides for the thickness of the through runner web 13. The height of the forward projection 32 above a lower edge 37 of the lead end 26 is less than the height of the slot 18 so that the projection 32 does not hinder insertion of the lead end into the slot. As will become apparent, when the connector 19 is installed, the web 13 of a through runner is positioned between the front projection 32, at one side, and the lower edge 31 and rear projection 33 to the other side.

Figures 2, 3, 4:
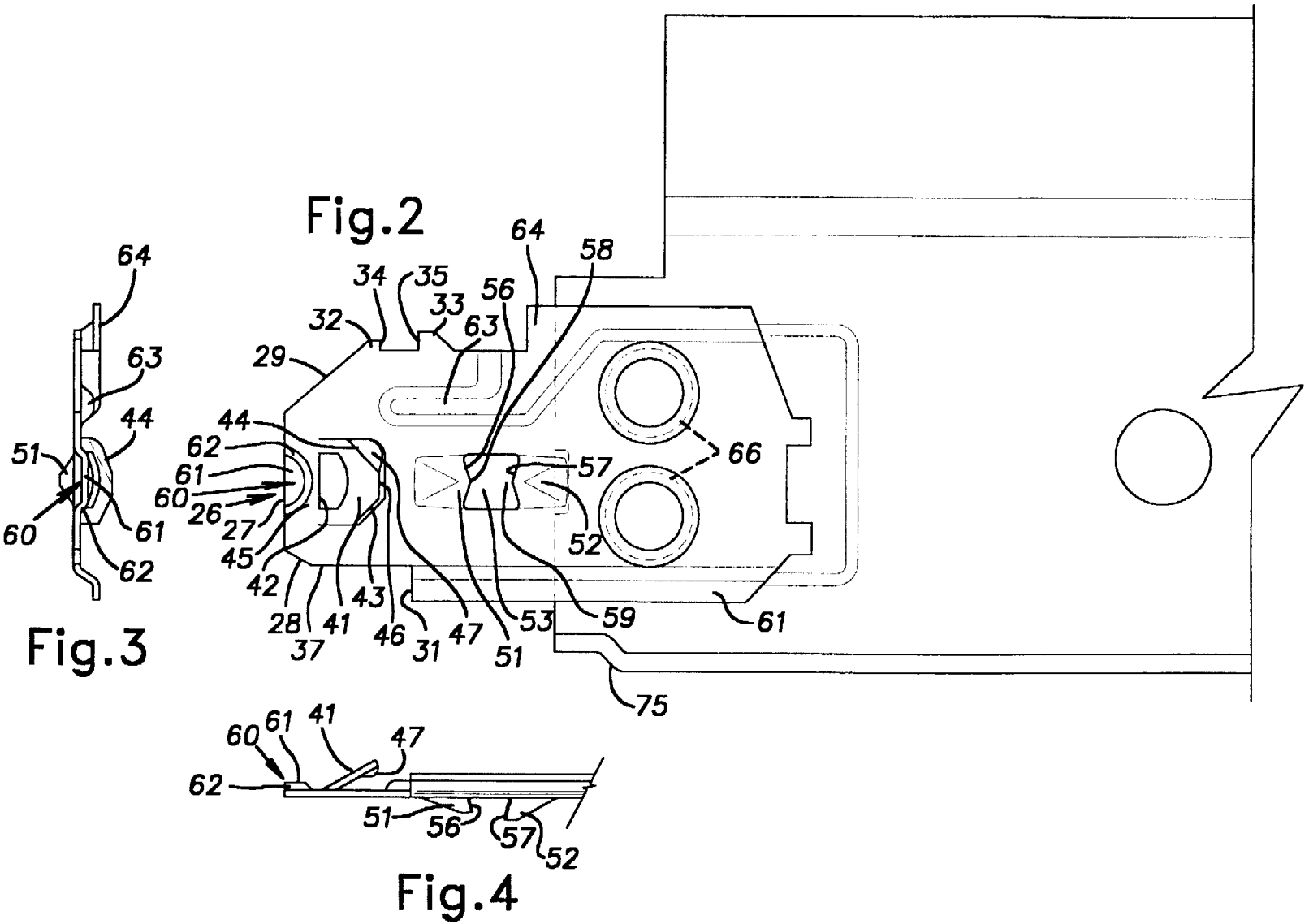
FIG. 2 is a side elevational view of a typical connector, shown in FIG. 1, and an associated portion of its runner.
FIG. 3 is a front end elevational view of the connector.
FIG. 4 is a fragmentary bottom view of the connector.
Figure 5:
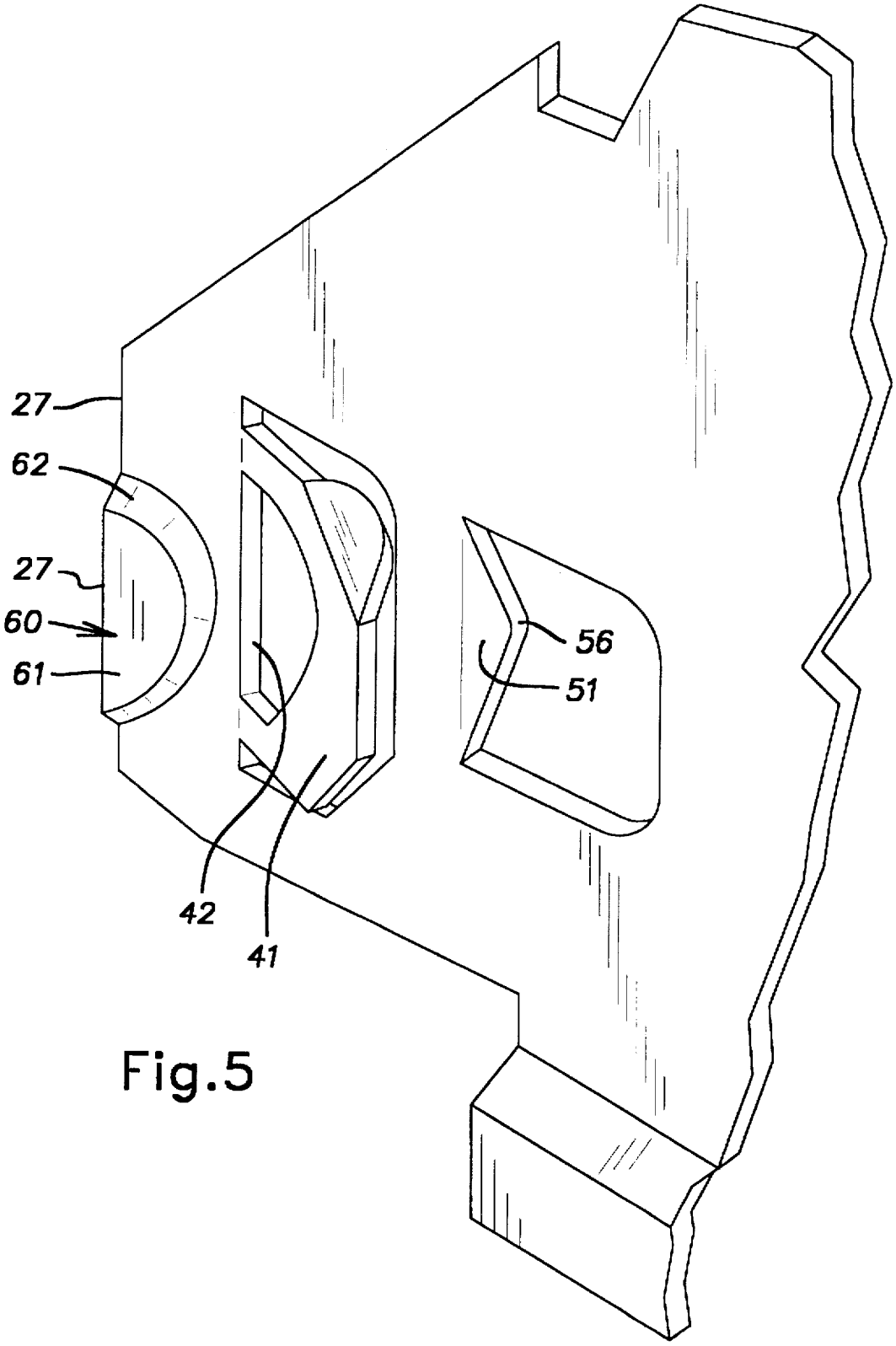
FIG. 5 is a rear perspective fragmentary view of the connector.

A generally U-shaped flag or lock tab 41 is lanced from the plane of the connector 19. The interior profile of the tab 41 is formed by a D-shaped hole that has a straight vertical edge 42 at a predetermined spacing from the lead edge 27 so as to leave in the forward connector area a land of stock 45 therebetween of fixed horizontal width. The surface of the edge 42 faces rearwardly. The tab 41 extends rearwardly and laterally outwardly (above the plane of the drawing of FIG. 2) from a base or bend line that is generally coincident with the hole edge 42. The free end of the tab 41, remote from its base adjacent the edge 42, has an upwardly angled lower edge 43 and a downwardly angled bend line 44 mutually converging toward a rearward vertical edge 46. A flap section 47 of the tab 41 generally rearward of and above the bend line 44 is bent inwardly to return towards the plane of the connector 19. The free edge 46 of the tab 41 is generally in the same imaginary vertical plane, transverse to the plane of the connector 19, as is the rear edge 34 of the forward projection 32.

Spaced rearwardly of the lock tab 41 is a pair of oppositely facing locking projections 51, 52 formed or lanced from the plane of the connector 19 to a side opposite that from which the tab projects. The projections 51, 52 are spaced from one another by an hour glass shaped hole 53. The projections 51, 52 are essentially mirror images of one another with each having a configuration loosely resembling three sides of a pyramid. The rearward projection 52 is somewhat larger in its lateral extension from the plane of the connector 19. Edges 56, 57 of the projections 51, 52 formed by the hole 53 are out of plumb with respect to a vertical line so that they form a point or apex 58, 59 as viewed, for example, in FIG. 2 and FIG. 4 and so that they present a slight undercut with reference to the rearward and forward directions from their respective points 58, 59. The surface of the edge 56 faces generally rearwardly and the surface of the edge 57 faces generally forwardly. Alternatively, the lateral projections 51, 52 can be lanced from the body of the connector with slits to form the edges 56, 57 or their equivalents without producing the hole 53. The projections 51, 52 are relatively strong as a result of their structures being continuous with the surrounding parts of the connector except for their respective edges 56, 57. The horizontal spacing between the projection points 58, 59 is desirably just slightly larger than the horizontal width of the land 45. As shown, the hole 53 has the same elevation as the land 45.

A relief area 60 in the land 45 forming the forward portion of the connector 19 is deformed laterally out of the plane of the connector to the same side to which the tab 41 extends and at the same elevation or vertical location as the projections 51, 52. In the illustrated case, the relief area 60 has the shape of a chordal segment of a circle so that it is larger in the vertical direction at the forward edge 27 than it is near the edge 42. More specifically, the illustrated relief area 60 is like a part of a dish or pan with a section 61 corresponding to the center of the dish and a surrounding section 62 corresponding to a conical rim of the dish. The land 45 which includes the relief area 60 and immediately surrounding parts of the forward portion of the connector is preferably continuous and free of holes, slots, notches or like discontinuities so as to afford high strength in the land.

Two vertically aligned holes 66 are punched in the rear portion of the connector 19 to enable it to be joined to a runner end 11 at the clinch-like connections 21. Preferably, the end of each runner 11 is embossed with a shallow pocket 67 having dimensions large enough to receive the rear portion of the connector 19. The lateral depth of the pocket is sufficient to generally make the associated runner 11 laterally centered with the slot 18.

The slot 18 which is elongated in the vertical direction has a polygonal profile with a central plane of symmetry. At its upper and lower ends, the slot 18 has short sides or ends 71, 72 respectively. The spacing of edges 70 and 82 respectively at each end of the slot 18 is proportioned to closely confine the thickness of the sheet stock of two connectors 19. A mid-section 74 represents the major width area of the slot 18. While the illustrated slot 18 has its profile formed as a polygon, equivalent arcuate segments can be used to achieve desired results.

A first runner 11 is connected to a through runner 10 by inserting the lead end 26 of its connector 19 into a selected slot 18 ideally with a stab-in motion essentially limited to translation along the longitudinal or horizontal axis of the runner 11. The connector 19 is thrust into the slot 18 until the lead edge 35 of the trailing projection 33 abuts the web 13 immediately above the slot end 71. During this motion, the tab or flag 41 bears against the side of the slot 18 in the mid-section 74 and by camming action therewith is squeezed toward the plane of the main body of the connector 19 until it passes fully through the slot 18. At this point, the tab 41 snaps back into its free configuration emitting an audible click essentially simultaneously with the seating of the projection edge 35 against the through runner web 13. The audible click assists the installer in ascertaining that the connector 19 has been fully installed. This condition is illustrated in FIG. 6. As shown in FIG. 6, the slot 18 and tab 41 are configured so that regardless of the lateral position of the first connector 19 in the slot, the free vertical edge 46 of the tab is laterally outside of at least portions of the slot so that the connector 19 is locked or caught on the web 13 of the through runner 10 because the tab 41 under ordinary axial forces cannot simply move axially back out of the slot.

A second runner 11 is connected to the through runner 10 by inserting its connector 19 into the slot 18 occupied by the first connector 19. In the illustrated design, the second connector 19 is inserted in the slot 18 to the left of the first connector 19 (when viewed from a reference point associated with the main part of this second runner being installed). Again, this installation is ideally accomplished by a stab-in motion parallel to the longitudinal or horizontal axis of the runner being installed. Besides effecting a lock of the associated tab 41 through the slot 18 (with an audible click), the assembly motion of the second connector 19 produces a connector-to-connector lock sometimes referred to as "hand shaking". This condition is depicted in FIG. 7 where it can be seen that upon full assembly of both connectors 19 in a slot 18 (with their stop edges 35 abutting or close to the faces of the web 13), the land 45 of one connector 19 is received and locked between the projections 51, 52 of the other connector and vice versa.

When the second connector 19 is inserted in the slot 18, the lateral offset of the relief area 60 allows the lead portions of each of the connectors to avoid interference with the forward projection 51 of the opposing connector. It is only when the rearward part of the relief area 60 formed by the conical wall 62 engages the projection 51 of the opposing connector 19 that any significant interference is developed between the connectors and the slot. The relief area 60 is proportioned in its vertical and lateral extent so that interfering engagement with the opposed projection 51 does not occur until the second connector is almost fully received in the slot 18. The lateral angular orientation of the peripheral conical part 62 of the relief area 60 is similar and complementary to the lateral angular configuration of the projection 51. As a result, the conical or angled portion 62 works as a cam when it engages and is ultimately forced completely over the projection 51 at the completion of the installation of the second connector into the slot 18. It will be understood that the forward end of each of the connectors resiliently bends laterally away from the opposing connector to accommodate the interference developed by the projections 51. Once the trailing end of the land 45, represented by the edge 42 clears the projection point 58 of the projection 51, the land 45 snaps into the space between the set of projections 51, 52 of the opposing connector. The lateral extension of the rear projection 52 at its projection point 59 is at least as large as the offset of the edge 27 at the vertical center of the relief area 60. This geometry assures that the rear projection 52 serves to lock the connectors in their assembled position against compressive forces along the longitudinal direction of the respective runners 11.

A study of FIG. 6 reveals that when contact between a rib 63 and the adjacent vertical slot edge is established, the connector 19 is confined laterally. Thus, when two connectors 19 are assembled in the same slot 18, significant lateral movement is prevented and the connectors are snugly held laterally against one another and a precisely controlled module length is achieved throughout a ceiling grid. This confinement assures that the lands 45 are held in the space between pairs of projections 51 and 52 for a reliable connection.

As discussed earlier, the width of the lands 45 in the longitudinal direction of the runner 11 is just slightly less than the gap between the points or apexes 58, 59 of the projections so that the connectors 19 and their associated runners 11 are precisely positioned relative to one another. On each side of the through runner web 13, a land 45 is restrained in tension and compression by the adjacent projections 51, 52. An exceptionally high restraining force level is achieved by the undercut provided by the receding or non-plumb edges 56, 57. This high restraining force results from the tongue and groove configuration provided by the land 45 and projections 51, 52, respectively. In particular, the land 45 acting as a tongue under a generally axial force between joined connectors extends into a generally vertical groove or undercut laterally underlying each of the projection points 58 or 59 resulting from the angularity or out of plumb orientation of the edges 56, 57. By extending into such a groove or recess the land and adjacent portions of the connector are positively gripped and prevented from bending laterally out of abutting contact with the opposed connector.

It will be understood that each of the runners 11 ordinarily has a connector 19 identical to that disclosed herein on the end opposite that shown in the figures. A connector 19 can be released or removed from the slot 18 by suitably twisting the through runner 10 and manipulating the cross runner to be released as is disclosed in aforementioned U.S. Pat. No. 5,517,796.

It has been found that a relief area such as the disclosed area 60 affords a surprising reduction in the force required to insert the second connector into a slot and, additionally, affords a surprising reduction in the variation of the required installation force. The disclosed relief area 60, particularly with its angular portion 62, avoids any tendency for the lead edge 27 to dig into the projection 51 and any coating on it. Additionally, the relief area 60 delays any significant interference between the lead portion or land 45 of the connector and the opposing projection 51 of the opposite connector until the second connector is nearly completely received in the slot 18 so that there is little tendency for the material of the through runner surrounding the slot to be deformed or gouged such as by the bevelled surface 29. As shown, the relief area 60 is at least large enough vertically and laterally to avoid the forward part of the projection 51 of the opposite connector.

It should be evident that this disclosure is by way of example and that various changes may be made by adding, modifying or eliminating details without departing from the fair scope of the teaching contained in this disclosure. For example, with a runner made of appropriate material the connector can be integrally formed with the runner web. The invention is therefore not limited to particular details of this disclosure except to the extent that the following claims are necessarily so limited.

We claim:

1. An end connector attached to a separate ceiling grid runner arranged to mate with an identical opposed connector in a common slot of a through runner, the connector comprising a forward end that is inserted first in a slot, a connector-to-connector lock including a lateral projection to one side of the connector and a rearwardly facing surface forward of the lateral projection, the lateral projection having a forward portion merging in a main plane of the connector and a rearward portion displaced laterally out of the main plane and being arranged to inter-engage the rearwardly facing surface of a mating connector to lock the mating connectors together, the connector, between the lateral projection and the rearwardly facing surface, being free of a projection extending to a side of the connector to which the lateral projection projects, a relief zone forward of the rearwardly facing surface and rearward of the forward end of the connector, the relief zone having a generally smooth configuration that reduces interference between the connector and the opposed mating connector at their respective lateral projections when being assembled through the slot of a through runner with an opposed mating connector, the geometry of the relief, the lateral projection and the connector portions therebetween of each of a pair of identical opposed mating connectors being arranged to delay lateral interference between such opposed mating connectors being installed at a slot at the lateral projections until the second connector is substantially received in the slot.

2. A connector as set forth in claim 1, wherein said relief zone extends laterally to a side opposite the side of the connector at which the lateral projection exists.

3. A connector as set forth in claim 1, wherein the connector is formed of sheet metal stock and said rearwardly facing surface is an edge of the connector sheet metal stock.

4. A connector as set forth in claim 1, wherein said relief zone is a concave area with reference to a side of the connector opposite the side to which the relief zone projects and is stamped into the body of the connector.

5. An end connector attached to a separate ceiling grid runner arranged to mate with an identical opposed connector in a common slot of a through runner, the connector comprising a profile with a downwardly tapered forward end that is inserted first in a slot, a connector-to-connector lock including a lateral projection and a rearwardly facing surface forward of the lateral projection, the lateral projection being arranged to inter-engage the rearwardly facing surface of a mating connector to lock the mating connectors together, a relief zone forward of the rearwardly facing surface and rearward of the forward end of the connector, the relief zone having a configuration that reduces interference between the connector and the opposed mating connector at their respective lateral projections when being assembled through the slot of a through runner with the opposed mating connector, the profile of the downwardly tapered forward end of the connector preventing the profile from vertically centering the connector in a slot when initially inserted in a slot, the relief zone being greater in vertical dimension at its forward end than at its rearward end and being sufficiently limited in vertical size relative to the vertical size of the lateral projection so that the relief zone is capable of vertically guiding the connector with an identical mating opposed connector in a slot by vertical inter-engagement between the relief zone and the lateral projection of the opposed connector.

6. An end connector attached to a separate ceiling grid runner, the connector being stamped out of sheet metal and being arranged to mate with a similar opposed connector in a common slot of a through runner, the connector comprising a forward end that is inserted first in a slot, a connector-to-connector lock including a lance projecting laterally of a plane of the connector with a rear face, a rearwardly facing surface forward of the lance, the area of the connector between the lance and the rearwardly facing surface being free of a projection to side of the connector from which the lance projects, a generally smooth relief area forward of the rearwardly facing surface, the relief area being stamped into concave configuration with reference to the side of the connector from which the lock lance projects, the relief area and surrounding parts of the connector being substantially free of discontinuities through a wall of the connector, the relief area and the area between the lance and the rearwardly facing surface having a configuration that reduces lateral interference between the connector and the opposed mating connector at their respective lock lances when being initially assembled through the slot of a through runner with the opposed mating connector.

7. An end connector as set forth in claim 6, wherein the lock lance is stamped in a manner such that it is continuously joined to remaining parts of the connector except at its rear face.

8. An end connector as set forth in claim 6, including a first end lock tab between the rearwardly facing surface and the lock lance.

9. An end connector for attached to a ceiling grid runner, the connector being stamped out of sheet metal and being arranged to mate with a similar opposed connector in a common slot of a through runner, the connector comprising a forward end that is inserted first in a slot, a connector-to-connector lock including a lance projecting laterally of a plane of the connector with a rear face, a rearwardly facing surface forward of the lance, a relief area forward of the rearwardly facing surface, the relief area being stamped into a concave configuration with reference to a side of the connector from which the lock lance projects, the relief area and surrounding parts of the connector being substantially free of discontinuities through a wall of the connector, the relief area having a configuration that reduces lateral interference between the connector and the opposed mating connector at their respective lock lances when being initially assembled through the slot of a through runner with the opposed mating connector, a lead edge and a second lance rearward of said lock lance, said second lance projecting laterally from a same side of the connector as does the lock lance, the second lance being arranged to engage the lead edge of the opposing mating connector to provide a compression interlock between opposed runners.

10. A connector as set forth in claim 9, wherein the relief area extends to said lead edge and said second lance projects laterally from the plane of the connector a distance greater than the lateral projection of the lock lance.

11. A connector as set forth in claim 6, wherein said relief area has a lateral angular component forming a cam surface when it engages said lock lance of the opposing connector to produce a low force movement of said relief area past said opposed lock lance.

* * * * *